United States Patent [19]

Porter

[11] Patent Number: 4,936,078

[45] Date of Patent: Jun. 26, 1990

[54] INTERCONNECTING PANELS

[76] Inventor: William H. Porter, P.O. Box 249, Saugatuck, Mich. 49453

[21] Appl. No.: 279,039

[22] Filed: Dec. 2, 1988

[51] Int. Cl.[5] ..... E04B 1/80; E04C 1/10

[52] U.S. Cl. ..... 52/595; 52/478

[58] Field of Search ..... 52/309.9, 478, 595

[56] References Cited

U.S. PATENT DOCUMENTS

| | | | |
|---|---|---|---|
| 938,768 | 11/1909 | Kenny . | |
| 2,339,865 | 1/1944 | Larmour . | |
| 2,730,772 | 1/1956 | Jones . | |
| 2,803,858 | 8/1957 | Rader . | |
| 2,907,287 | 10/1959 | Trostle . | |
| 2,916,261 | 12/1959 | Parkinson et al. . | |
| 2,962,323 | 11/1960 | McBride . | |
| 3,111,787 | 11/1963 | Chamberlain . | |
| 3,228,822 | 1/1966 | Norman . | |
| 3,313,073 | 4/1967 | Mathews . | |
| 3,415,028 | 12/1968 | Nerem . | |
| 3,514,915 | 6/1970 | Johnson | 52/588 |
| 3,535,844 | 10/1970 | Glaros | 52/595 |
| 3,667,180 | 6/1972 | Tischuk . | |
| 3,789,556 | 2/1974 | Skinner . | |
| 3,818,659 | 6/1974 | Anderson . | |
| 3,835,606 | 9/1974 | Liberman . | |
| 3,886,676 | 6/1975 | Alfonso . | |
| 3,975,880 | 8/1976 | Fischer, Jr. . | |
| 4,009,548 | 3/1977 | Hicks . | |
| 4,020,611 | 5/1977 | Amos . | |
| 4,037,377 | 7/1977 | Howell et al. . | |
| 4,068,437 | 1/1978 | Byxbe et al. . | |
| 4,100,710 | 7/1978 | Kowallik . | |
| 4,104,840 | 8/1978 | Heintz et al. . | |
| 4,135,342 | 1/1979 | Cotter . | |
| 4,139,974 | 2/1979 | Fox . | |
| 4,155,206 | 5/1979 | Player . | |
| 4,244,151 | 1/1981 | Seem . | |
| 4,246,735 | 1/1981 | Herzfeld . | |
| 4,304,083 | 12/1981 | Anderson | 52/309.9 |
| 4,307,553 | 12/1981 | Puckett . | |
| 4,316,351 | 2/1982 | Ting | 52/478 |
| 4,366,656 | 1/1983 | Simpson . | |
| 4,435,934 | 3/1984 | Kim . | |
| 4,443,988 | 4/1984 | Coutu, Sr. . | |
| 4,575,981 | 3/1986 | Porter . | |
| 4,599,842 | 7/1986 | Counihan . | |
| 4,671,038 | 6/1987 | Porter . | |
| 4,700,520 | 10/1987 | Ting | 52/478 |
| 4,769,963 | 9/1988 | Meyerson | 52/307.9 |

FOREIGN PATENT DOCUMENTS

| | | | |
|---|---|---|---|
| 2292085 | 11/1974 | France | 52/595 |

*Primary Examiner*—David A. Scherbel
*Assistant Examiner*—Michele A. Von Patten
*Attorney, Agent, or Firm*—Emrich & Dithmar

[57] ABSTRACT

Interlocking panels having a pair of spaced sharp edges on one end and a pair of spaced recesses on another, opposed end are adapted for sealed connection when placed in edge-to-edge abutting contact. Each of the spaced recesses is adapted to receive a penetrable strip of sealant which is engaged and penetrated by a respective one of the sharp edges of another panel positioned in edge-to-edge abutting contact. Each panel includes a pair of spaced facings, or sheets, with an insulating core disposed therebetween, and with each facing having at one end an aforementioned sharp edge and at an opposite end an aforementioned recess. The sharp edges and recesses are displaced inward from the facing surfaces of the panel defined by the aforementioned spaced facings, with adjacent edges of abutting panels arranged in a closely spaced manner to form an internal channel, which may serve as a rain gutter, or which may be covered with a sealing batten, if desired. Fastening means for mounting the panels may also be located within the internal channel in a hidden manner.

25 Claims, 1 Drawing Sheet

INTERCONNECTING PANELS

BACKGROUND OF THE INVENTION

This invention relates generally to building panels and is particularly directed to the sealed coupling of abutting, interlocking building panels.

Modular panels arranged in abutting relationship to form the walls and roof of a building have been used for years in the construction of prefabricated structures. These modular panels are also increasingly being used for house additions and have become commonly known as roof deck panels, stress-skin panels, curtain wall panels, or sandwich panels. These panels should ideally be inexpensive, of simple design requiring minimal coupling/mounting hardware, and easily produced and installed. Moreover, such panels should be aesthetically pleasing by minimizing the visibility of inter-panel seam lines and hiding the aforementioned mounting/coupling hardware from view. The seal between adjacent interlocking panels should be easily assembled, highly reliable and resistant to the elements, and inconspicuous. Finally, the panels should be usable in both wall and roof construction and should be easily mounted to a supported structure and securely attached to one another.

The present invention affords the aforementioned advantages in an interconnecting panel having a pair of watertight seals on each end thereof when placed in edge-to-edge abutting contact with another similar panel. The panel is comprised of inner and outer faces, preferably of sheet metal, which faces are identical in size and configuration for reduced cost, with an intermediate insulating core disposed between the two faces. Adjacent edges of interconnecting panels are in closely spaced relation, with the interlocking seals and a rain gutter disposed internal to the panels and out of sight.

Objects and Summary of the Invention

Accordingly, it is an object of the present invention to provide an improved sealing and coupling arrangement for interconnecting building panels arranged in an edge-to-edge abutting manner.

It is another object of the present invention to provide a panel interconnection arrangement which is easily assembled, provides sealed engagement between connected panels, and hides the seals and connecting-/mounting hardware from view.

Yet another object of the present invention is to provide a gutter arrangement for interlocking building panels which is hidden from view and makes use of only the panel structure without additional hardware or attachments.

A further object of the present invention is to provide a sealed coupling arrangement for interconnecting building panels which makes use of a curable, penetrable sealant disposed on one end of the panel and a sharp edge on the panel's other end, wherein the sharp edge of one panel is inserted into the sealant of another panel for forming a secure, sealed interpanel connection.

Yet another object of the present invention is to minimize the space between interconnecting building panels by placing the sealing, mounting and coupling components within the panel and to thus make the joint less conspicuous.

This invention contemplates interconnecting panels for use on the construction of a building wherein a plurality of such panels are arranged in an abutting, edge-to-edge manner, with each of the panels comprising: an outer face and an inner face; an insulating core disposed between and in contact with the outer and inner faces; a sealant retainer disposed on a first end of the panel for maintaining first and second spaced deposits of a penetrable sealant in position on the panel, wherein the first and second sealant deposits extend the width of the panel; and first and second spaced sharp edges disposed on a second, opposed end of the panel and extending the width thereof, wherein each of the sharp edges is adapted for insertion into a respective one of the sealant deposits when a pair of the panels are positioned in abutting, end-to-end contact in forming a sealed coupling between the panels.

Brief Description of the Drawings

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

Description of the Preferred Embodiments

Figure 1:
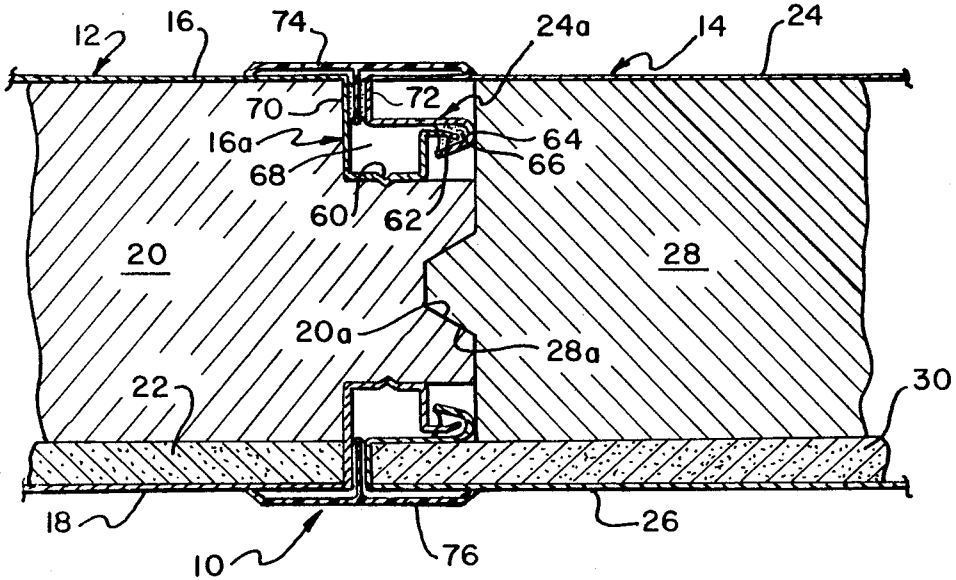
FIG. 1 is a sectional view of a sealed coupling arrangement between a pair of interconnecting panels in accordance with the present invention.

Referring to FIG. 1, there is shown a sectional view of an interconnecting panel arrangement 10 in accordance with the present invention. The interconnecting panel arrangement 10 couples a first panel 12 to a second panel 14. The first panel 12 includes an outer facing sheet 16 and an inner facing sheet 18, with an insulating core 20 disposed between and in contact with the facing sheets. The second panel 14 also includes an outer facing sheet 24, an inner facing sheet 26 and an insulating core 28 disposed therebetween. Each of the aforementioned facing sheets is preferably comprised of a roll formed metal sheet, while the insulating cores 20 and 28 are comprised of a rigid foam plastic in a preferred embodiment. The core material is rigidly bonded to its associated pair of facing sheets to form an integrated single piece assembly for high rigidity and strength. This allows large panels capable of spanning extended distances to be used for the exterior cover of buildings. The insulating cores may range in thickness from 2 inches to 8 inches, depending upon its structural application.

Respective ends of the insulating cores 20 and 28 may be provided with complementary configurations for panel interconnecting. For example, the insulating core 20 of the first panel 12 is shown with a recessed end **20*a*, while the adjacent edge of the insulating core 28 of the second panel 14 is provided with a complementary extended portion 28*a* for insertion into the recessed portion of the first panel. The inner portions of each of the first and second panels 12, 14** may be provided with respective dry wall sections 22 and 30 to meet applicable fire codes. As shown in the figure, the dry wall sections 22 and 30 are each disposed between the insulating core of a panel and its inner facing sheet.

Figure 3:
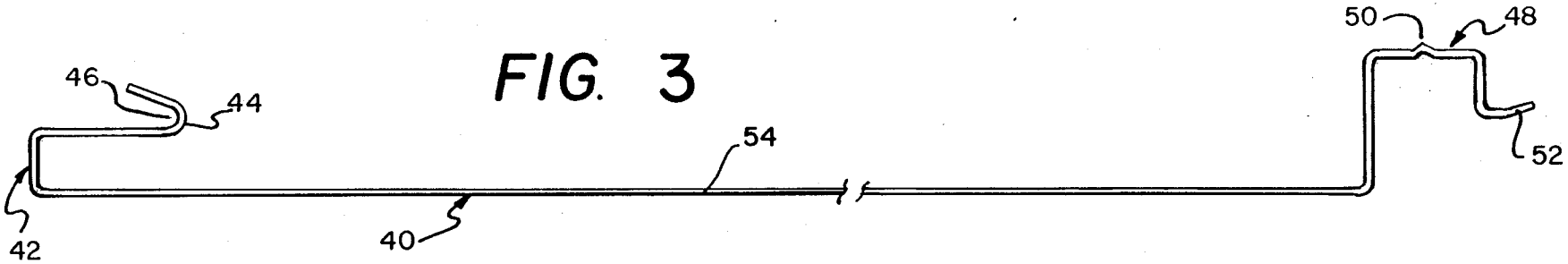
FIG. 3 is a side view of a facing sheet used on the outer and inner surfaces of an interconnecting panel in accordance with the present invention.

With reference to FIG. 1 as well as to FIG. 3, the configuration of the interconnecting panels of the present invention will now be described in detail. As shown in FIG. 3, the facing sheet 40 includes a first end 42, a second end 48, and an intermediate planar portion 54 disposed therebetween. The facing sheet 40 may be used on either the outer or inner surface of an interconnecting panel, with all such interconnecting panels making use of a pair of facing sheets 40 as shown in FIG. 3. The use of a pair of identical facing sheets for all interconnecting panels simplifies panel fabrication and minimizes cost.

The first end 42 of the facing sheet 40 includes a generally rectangular portion and a curved edge 44 extending the width of the sheet. The curved edge 44 defines a V-groove, or slot, 46 on the end of the facing sheet 40. The V-groove 46 is adapted for receiving a strip of sealant (not shown) as described in detail below. The second end 48 of the facing sheet 40 also includes a plurality of right angled sections and terminates in a straight edge 52 which also extends the width of the sheet. Disposed on an intermediate portion of the second end 48 is a starter groove 50 which also extends the width of the sheet, the purpose of which is described below.

Referring again to FIG. 1, the manner in which the first and second panels 12, 14 are connected in a sealed manner will now be described. The end 16*a* of the first panel's outer facing sheet 16 is provided with a straight edge 62 extending the width of the panel. The end 16*a* of the first panel's outer facing sheet 16 is shaped so as to form a channel, or duct, 68 which also extends the width of the first panel 12. The channel 68 may serve as a rain gutter where the panels are used in a roof. With the first and second panels 12, 14 positioned in abutting contact, adjacent portions of their outer facing sheets 16, 24 are positioned in closely spaced relation. Thus, a first flat end portion 70 of the outer facing sheet 16 is closely positioned to a second flat end portion 72 of outer facing sheet 24. The end 24*a* of outer facing sheet 24 is provided with a curved edge 64 defining a V-groove, or slot, which is adapted to receive and retain a sealant 66 positioned therein. The sealant is preferably comprised of an initially deformable, curable material such as silicon or urethane which extends the width of the second panel 14 within the V-groove. With the first and second panels 12, 14 in mutual alignment and positioned in abutting contact, the straight edge 62 of the first panel's outer facing sheet 16 is inserted into the penetrable sealant 66 disposed within the V-groove defined by the curved edge 64 of the second panel's upper facing sheet 24. The adhesiveness of the sealant 66 ensures its retention in the V-groove formed by the curved edge 64 of the outer facing sheet 24, while its penetrability allows the edge 62 of the first panel's outer facing sheet 16 to be inserted into the sealant. Following curing of the sealing 66, the first and second panels 12, 14 remain securely coupled together in a sealed manner. A similar sealing arrangement is provided for in the inner facing sheets 18, 26 of the first and second panels 12, 14 as shown in FIG. 1.

The gap between the first and second flat end portions 70, 72 of the outer facing sheets 16 and 24 allows water to run from the upper surface of the interconnecting panel arrangement 10 into the generally rectangular-shaped channel 68 defined by adjacent portions of each of the aforementioned upper facing sheets. The sealed coupling formed by the edge 62 and the sealant 66 is disposed above the lower portion of the channel 68 which allows water to flow within the channel without exerting pressure on the V-seal. In most cases, water can flow within the channel or rain gutter 68 without even coming into contact with the V-seal formed by the edge 62 and sealant 66. A similar channel arrangement is located in a lower portion of the interconnecting panel arrangement 10, although the lower rain gutter would not generally be needed or used. Disposed in a lower section of the outer facing sheet section 16*a* defining a portion of the channel 68 is a starter groove 60. The starter groove 60 extends the width of the panels and facilitates the insertion of a mounting pin, such as a nail (not shown), for securely attaching the first and second panels 12, 14 to a support structure (also not shown in FIG. 1).

The gap between the respective first and second flat end portions 70, 72 of the first and second outer facing sheets 16, 24 is adapted to receive the insert portion of a snap-in batten 74. The insert portion of the snap-in batten 74 may be provided with a plurality of facing, spaced sets of angled teeth for securely maintaining the batten in engagement with the first and second flat end portions 70, 72 of the outer facing sheets 16 and 24. With the snap-in batten 74 securely in position between the first and second outer facings 16, 24, an external seal is provided on the outer surface of the interconnecting panel arrangement 10 preventing water from flowing in the channel 68. A lower, or inner, portion of the interconnecting panel arrangement 10 where the inner facing sheets 18 and 26 are positioned in closely spaced relation, is adapted to receive a similar snap-in batten 76 which seals and conceals a lower portion of the joint between the first and second panels 12, 14.

As shown in FIG. 1, space is provided above and below the combination of the straight edge 62, the curved edge 64 and the sealant 66 coupling these two ends of the outer facing sheets 16 and 24. The flexibility of the ends of the outer facing sheets 16, 24 allows for metal expansion while the adjoining panels are bonded together in the V-groove. This flexibility, in combination with the strength of the seal thus formed, maintains these adjacent edges of the outer facing sheets 16 and 24 in sealed engagement under a wide range of environmental conditions to which a roof is typically subjected such as excessive heat, heavy water flow, ice expansion in the rain gutter, etc.

Figure 2:
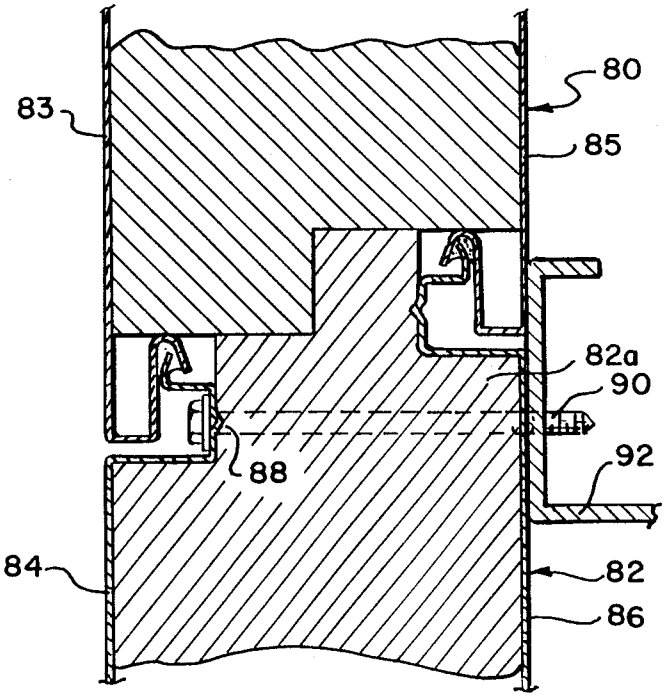
FIG. 2 is a sectional view of a sealed coupling arrangement for interconnecting panels which further includes means for mounting the interlocking panels to a support structure in accordance with the present invention.

Referring to FIG. 2, there is shown a sectional view of another embodiment of an interconnecting panel arrangement in accordance with the principles of the present invention. The arrangement shown in FIG. 2 is representative of the installation of the inventive interconnecting panel arrangement in a wall installation. In this approach, the ends of the inner and outer facing sheets are offset from one another. Thus, the inner facing sheet 86 of the lower panel 82 extends upward further than the end of the panel's outer facing sheet 84. Similarly, in the upper panel 80 the outer facing sheet 83 extends lower than the panel's inner facing sheet 85. The upper, offset end of the lower panel's outer facing sheet 84 is provided with a starter groove 88 extending the width thereof. The starter groove 88 in combination with the offset alignment of the outer and inner end portions of both panels facilitates the insertion of a conventional fastener, such as a nail or screw, 90 through the lower panel 82 and into a building frame member 92. In this manner, the lower panel 82 may be securely mounted to the building frame member 92. With the lower panel 82 attached to the building frame member 92, and with sealant disposed within the V-grooves of the upper panel 80, the upper panel may be positioned in abutting contact with the upper edge of the lower panel so as to form a secure, sealed coupling therewith following curing of the pair of sealant deposits. A snap-in batten as shown in FIG. 1 may then be inserted in the slot between the adjacent edge portions of the outer facing sheets of the upper and lower panels 80, 82 to conceal the joint between the two panels as well as the panel mounting hardware.

There has thus been shown an interconnecting panel arrangement for coupling a pair of building panels in sealed engagement. An edge of a first panel is provided with a pair of spaced recesses, each adapted for receiving a penetrable, curable sealant strip, while the second panel includes a pair of spaced straight edges. Each of the straight edges is inserted into a respective sealant strip when the panels are positioned in abutting contact, forming a dual seal between the two panels following curing of the sealant. A recessed rain gutter is provided within the panel juncture and the entire panel joint may be hidden from view by a snap-in batten inserted between adjacent, facing edges of the panels. Fastening means for mounting the panels may also be located within the recessed portion of the panel juncture in a hidden manner.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In interconnecting panel having a length and a width for use in the construction of a building wherein a plurality of such panels are arranged in an abutting, edge-to-edge manner, each of said panels comprising: an outer face and an inner face, wherein said outer and inner faces are each comprised of a sheet-like member and wherein each of said sheet-like members are of the same size and configuration; an insulating core disposed between and in contact with said outer and inner faces; sealant retaining means disposed on a first end of said panel for maintaining first and second spaced deposits of a penetrable sealant in position on the panel, wherein said first and second sealant deposits extend with width of the panel; first and second spaced sharp edges each defined as a respective termination of a sheet-like member and disposed on a second, opposed end of said panel and extending the width thereof, wherein each of said sharp edges is adapted for insertion into a respective one of said sealant deposits when a pair of the panels are positioned in abutting, end-to-end contact in forming a sealed coupling between the panels; and first and second channels extending the width of the panel and respectively formed in a spaced manner between adjacent ends of said outer and inner faces of a pair of panels arranged in abutting, end-to-end contact, wherein a portion of the insulating core of one of the panels is disposed intermediate said channels and said first and second channels are respectively disposed adjacent to said outer and inner faces and said first and second channels are offset from one another relative to the end of the panel so as to form an end extension of the panel for inserting a mounting pin therethrough in attaching the panel to a support structure.

2. An interconnecting panel as in claim 1 wherein each of said sheet-like members is comprised of rolled sheet metal.

3. An interconnecting panel as in claim 1 wherein said sealant retaining means are disposed on respective first ends of said outer and inner faces and said spaced edges are disposed on second respective opposed ends of said outer and inner faces.

4. An interconnecting panel as in claim 3 wherein said sealant retaining means includes first and second recessed portions on respective adjacent ends of said outer and inner faces, and wherein each of said recessed end portions are adapted for retaining and supporting a respective sealant deposit.

5. An interconnecting panel as in claim 4 wherein said first and second recessed portions are each comprised of a respective V-groove on the end of each of said outer and inner faces.

6. An interconnecting panel as in claim 4 wherein each of said sealant deposits is comprised of a curable adhesive material.

7. An interconnecting panel as in claim 6 wherein said curable adhesive material is urethane.

8. An interconnecting panel as in claim 6 wherein said curable adhesive material is silicone.

9. An interconnecting panel as in claim 1 wherein abutting ends of adjacent panels include complementary insert and slot arrangements for providing keyed, matching coupling between adjacent panels.

10. An interconnecting panel as in claim 1 further comprising sealing means disposed along and in contact with adjacent facing portions of a pair of panels arranged in abutting, end-to-end contact and in further contact with said outer and inner faces so as to seal each of said channels along the width of said outer and inner faces.

11. An interconnecting panel as in claim 10 wherein said sealing means comprises first and second snap-in battens.

12. An interconnecting panel as in claim 11 further comprising a starter groove in an end portion of each of said outer and inner faces forming a channel and extending the width of the panel for facilitating insertion of a mounting pin through an end of the panel for attaching the panel to a support structure.

13. An interconnecting panel as in claim 1 further comprising a sheet of dry wall disposed between and in contact with said insulating core and said inner face.

14. An interconnecting panel as in claim 1 further comprising a starter groove within said end extension and extending the width of the panel for facilitating insertion of a mounting pin through said end extension.

15. An interconnecting panel as in claim 1 wherein said insulating core is comprised of rigid foam plastic.

16. A sealed joint between first and second edge-abutting building panels each having inner and outer faces and an insulating core therebetween, said join comprising: first and second spaced, linear, sharp edges disposed on and extending from an inner portion of an end of the first panel; first and second spaced, linear recesses disposed on and extending from an inner portion of an end of the second panel, wherein said first and second sharp edges are respectively disposed within said first and second recesses when the panels are positioned in edge-abutting contact and wherein each of said panels are of the same size and configuration; first and second penetrable sealant means respectively disposed within said first and second recesses and penetrated by said first and second sharp edges, respectively, when the panels are positioned in edge-abutting contact in forming a sealed connection therebetween; and first and second channels respectively formed between adjacent ends of the outer and inner faces of said first and second panels, wherein said first and second channels are disposed in an offset manner relative to one another to form an end extension of the panel adapted to receive a mounting pin for attaching the panel to a support structure; and wherein said first and second channels are disposed in a spaced manner within the joint between the first and second panels, with a portion of the insulating core disposed intermediate said first and second channels and wherein each of said channels is disposed within the sealed joint adjacent to a respective one of the inner and outer faces thereof.

17. The sealed joint of claim 16 wherein said first channel includes a lower portion disposed beneath the adjacent sealant means.

18. The sealed joint of claim 17 wherein the lower portion of said first channel includes a starter groove to facilitate insertion of a mounting pin through an end of a panel.

19. The sealed joint of claim 18 wherein the ends of each pair of inner and outer faces are offset from one another to facilitate insertion of a mounting pin through an end of a panel.

20. The sealed joint of claim 16 said sharp edges are on adjacent ends of inner and outer faces of the first panel and said recesses are on adjacent ends of inner and outer faces of the second panel.

21. The sealed joint of claim 20 wherein each of said first and second channels is coupled to an exterior surface of a panel via a respective narrow slot in the joint between the panels.

22. The sealed joint of claim 21 further comprising first and second seals each inserted into a respective one of said narrow slots for sealing off a respective one of said channels from an exterior surface of a panel.

23. The sealed joint of claim 16 wherein each of said recesses is in the form of a V-groove disposed on the end of a face.

24. The sealed joint of claim 23 wherein each of said sealant means is a strip of silicone disposed in a respective V-groove and extending the width of a panel.

25. The sealed joint of claim 23 wherein each of said sealant means is a strip of urethane disposed in a respective V-groove and extending the width of a panel.

* * * * *